United States Patent [19]

Bailey et al.

[11] 4,392,708

[45] Jul. 12, 1983

[54] ELECTRICAL JACK

[75] Inventors: James R. Bailey, Chicago; Kurt Lutzenberger, Arlington Heights, both of Ill.

[73] Assignee: Switchcraft, Inc., Chicago, Ill.

[21] Appl. No.: 174,788

[22] Filed: Aug. 4, 1980

[51] Int. Cl.[3] ..... H01R 13/50; H01R 17/18

[52] U.S. Cl. ..... 339/182 R

[58] Field of Search ..... 339/182, 183; 200/51.1

[56] References Cited

U.S. PATENT DOCUMENTS

| | | | |
|---|---|---|---|
| 3,001,165 | 9/1961 | Woofter et al. | 339/170 |
| 3,949,180 | 4/1976 | Ohgami et al. | 200/51.1 |
| 4,037,913 | 7/1977 | Deitch et al. | 339/182 R X |

*Primary Examiner*—Eugene F. Desmond

*Attorney, Agent, or Firm*—John T. Meaney; Joseph D. Pannone; R. M. Sharkansky

[57] ABSTRACT

An electrical jack having a housing of insulating material with integral walls thereof forming a cavity. A front wall of the housing has an axially extending hollow collar member with a passageway for guiding a stem of a jack plug into the cavity. A plurality of spring contactor electrodes are disposed within the housing cavity and are adapted to engage predetermined portions of the jack plug stem when such stem is inserted into the cavity to establish electrically conductive paths between the contactor electrodes and the portions of the jack plug. An additional electrical contactor, having an aperture formed in a mounting portion thereof, is disposed around the collar member, such mounting portion being disposed outside the housing cavity. The additional electrical contactor has a finger electrode protruding across the front wall into the cavity to electrically contact a portion of the inserted jack stem. With such arrangement, in applications where it is desired to have such contacted portion of the jack plug electrically connected to a conductive mounting panel disposed orthogonal to the axis of the plug, the mounting portion of the electrical contactor is placed in contact with the panel and where such electrical contact to the panel is not desired an insulated washer is used to insulate the contactor from the panel. The additional electrical contactor also has integrally formed spring members for clamping a cover for such cavity to the housing and an electrode adapted for electrically connecting the contactor to a horizontally disposed printed circuit board.

6 Claims, 14 Drawing Figures

FIG. 1
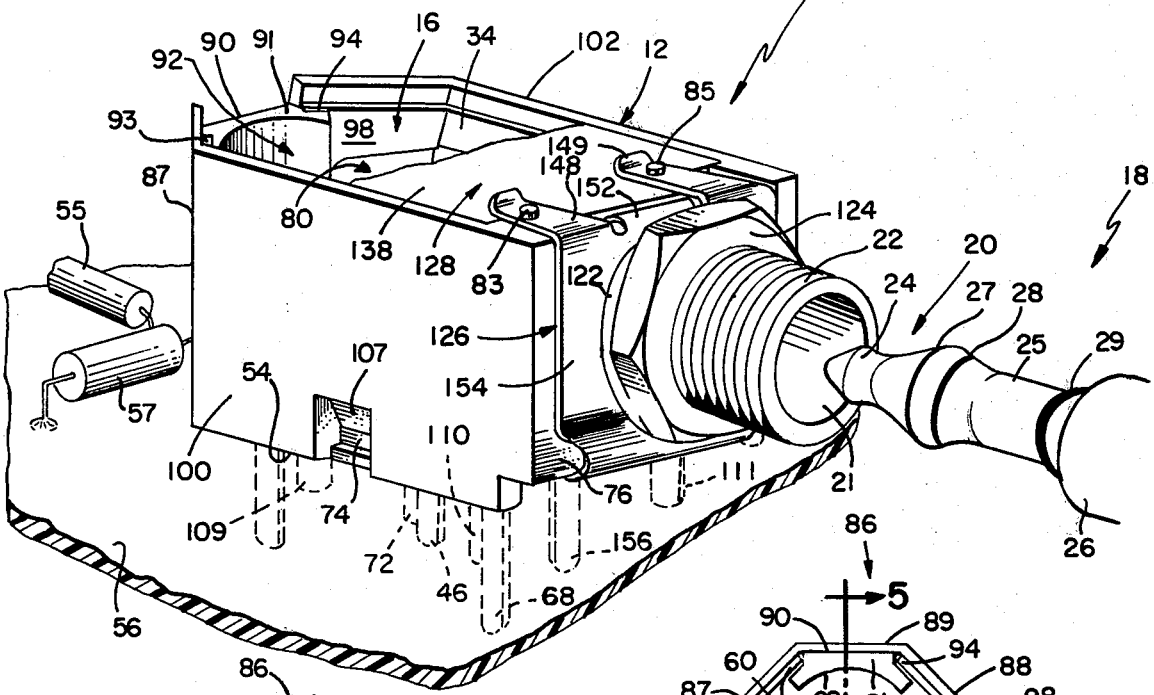
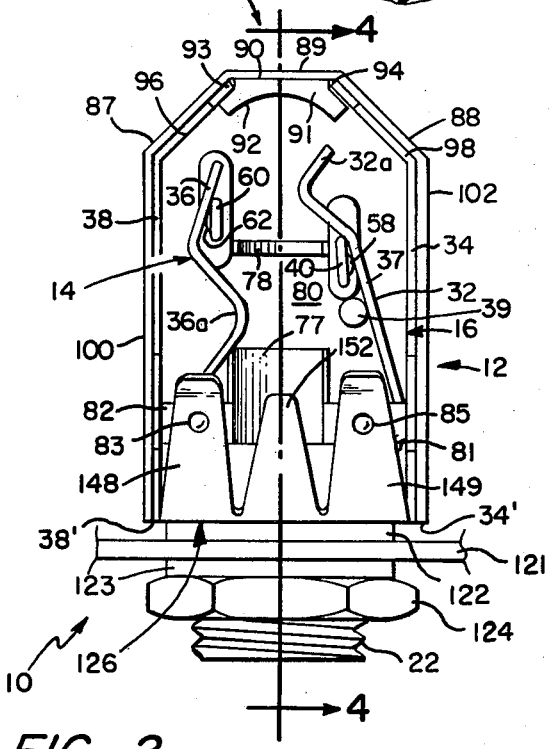
FIG. 2
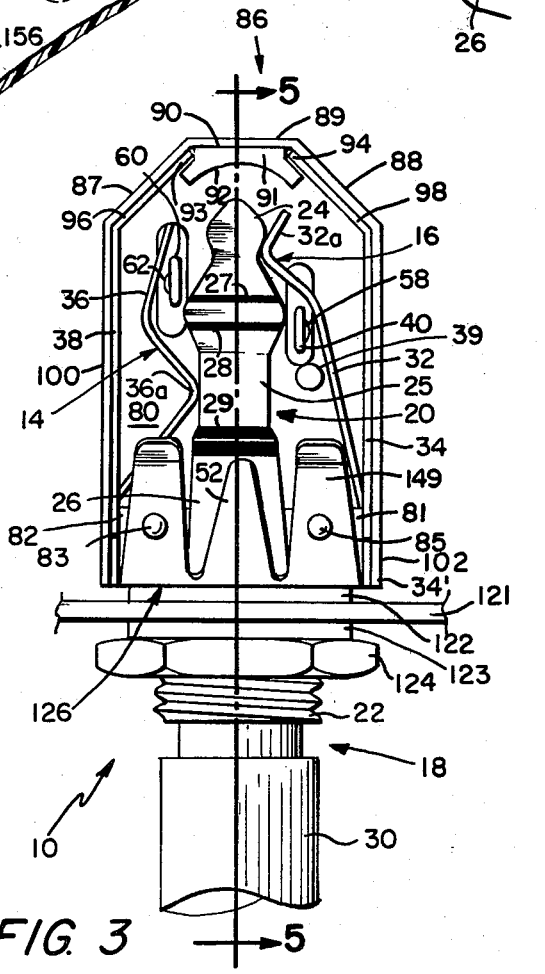
FIG. 3

ELECTRICAL JACK

BACKGROUND OF THE INVENTION

This invention relates generally to electrical jacks and more particularly to electrical jacks adapted to receive an electrical jack plug and provide electrical connection to a printed circuit board disposed in a plane parallel to the axis of the electrical jack plug.

As is known in the art, it is sometimes desirable to have electrical contact members of an electrical jack plug disposed orthogonal to the axis of a plug insertable into the jack housing. Such jacks are then adapted for mounting to a vertical conductive panel, as in a telephone switch board, to receive a jack plug as it is inserted into the housing along an axis orthogonal to the plane of the vertical panel. The electrical connectors extend vertically from a cavity defined by the walls of the jack housing, where they make proper electrical contact to selected isolated regions of the jack plug, for engagement with conductors or contacts of a horizontally disposed printed circuit board. In some applications it is desired to electrically connect a portion of the jack plug to the vertical conductive panel while in other applications it is desired that such portion of the jack plug be electrically insulated from the panel. It is also desirable to integrally form or mold the housing with an open top so that the electrical contacts having portions disposed within the cavity of the housing for engagement with portions of the inserted jack plug may be easily inserted through the open top into slots formed in the walls of the housing. However, in many applications it is sometimes necessary to provide a dust cover for the housing after the contacts have been inserted within the housing. Further, in order to reduce the cost of the jack, it is desired to have as few parts as possible. It follows then that it is desirable to integrate as many functions as possible into each component of the jack in order to reduce its cost.

SUMMARY OF THE INVENTION

In accordance with the present invention an electrical jack is provided having a housing of insulating material with integral walls thereof forming a cavity. A front wall of the housing has an axially extending hollow collar member with a passageway for guiding a stem of a jack plug into the cavity. A plurality of spring contactor electrodes are disposed within the housing cavity and are adapted to engage predetermined portions of the jack plug stem when such stem is inserted into the cavity to establish electrically conductive paths between the contactor electrode and the portions of the jack plug. An additional electrical contactor, having an aperture formed in a mounting portion thereof, is disposed around the collar member, such mounting portion being disposed outside the housing cavity. The additional electrical contactor has a finger electrode protruding across the front wall into the cavity to electrically contact a portion of the inserted jack stem. With such arrangement, in applications where it is desired to have such contacted portion of the jack plug electrically connected to a conductive mounting panel disposed orthogonal to the axis of the plug the mounting portion of the electrical contactor is placed in contact with the panel and where such electrical contact to the panel is not desired an insulated washer is used to insulate the contactor from the panel and an electrode adapted for electrically connecting the contactor to a horizontally disposed printed circuit board.

BRIEF DESCRIPTION OF THE DRAWINGS

The foregoing advantages and other features of the present invention will become apparent after reference to the following detailed description together with the accompanying drawings disclosing a preferred embodiment of the invention, wherein:

FIG. 1 is a perspective view of an illustrative embodiment of the invention, with a portion of the jack housing cover removed, such embodiment shown horizontally mounted and adapted for axial insertion of the plug stem in the housing;

FIG. 2 is a plan view of the embodiment of the invention shown in FIG. 1 with the cover removed;

FIG. 3 is a similar view to FIG. 2 illustrative of the embodiment of the invention after insertion of the jack plug stem horizontally and axially along the longitudinal axis of the jack housing;

DESCRIPTION OF THE PREFERRED EMBODIMENT

Figure 4:
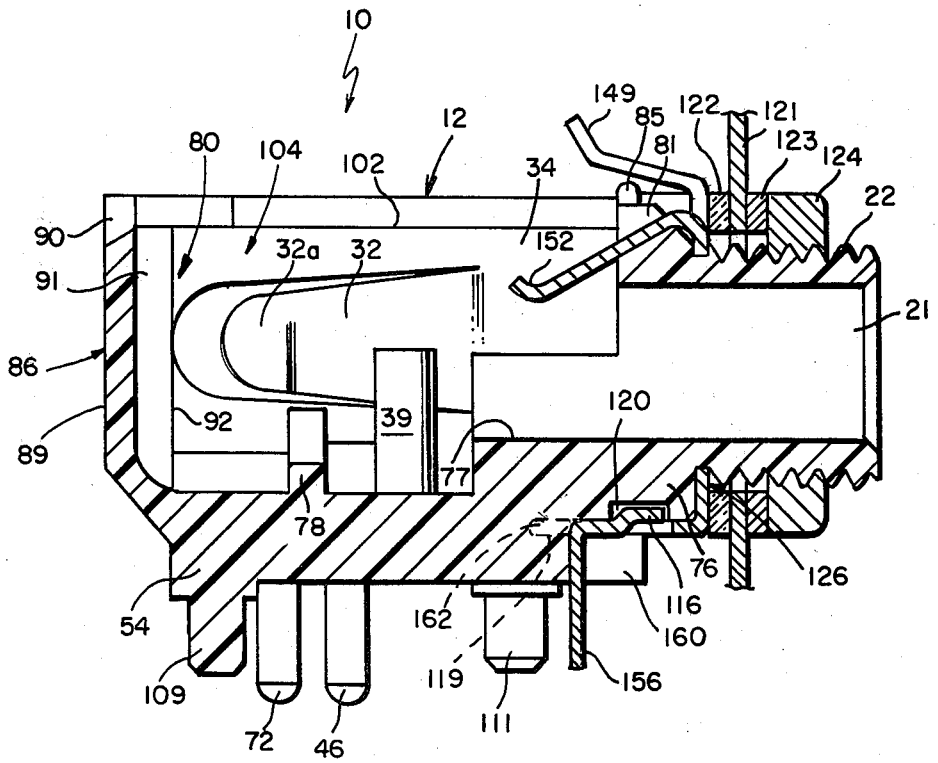
FIG. 4 is a side elevation view of the embodiment partly in cross section taken along the line and viewed in the direction of arrows 4—4 in FIG. 2.

A preferred embodiment of the invention, as illustrated particularly in FIGS. 1–6, comprises an electrical jack 10 having a rigid, generally rectangular, parallelpiped, box-like housing 12 molded as an integral unitary structure of a preferred or conventional moldable insulating material. Yieldable jack plug stem engaging spring contactor electrodes 14, 16 are mounted internally within cavity 80 defined by the planar housing walls. A conventional jack plug 18 having an elongated stem 20 is inserted axially, here horizontally, through plug stem guiding passageway 21 of collar member 22 parallel to mounting board 56 into the cavity 80. Collar member 22 is threaded to receive mounting nut 124 and is molded as an integral component of the unitary jack housing 12.

Elongated jack plug stem 20 incorporates a tip 24, ring 25 and sleeve portions 26 of a conductive material, electrically insulated from each other by annular spacers 27, 28 and 29 of a material such as plastic. The tip, ring and sleeve portions are individually electrically connected to external circuits by conductor means, typically wires, (not shown) extending within handle 30. Alternative electrical jack arrangements having only a two contactor electrode structure may include a jack plug stem omitting the ring portion 25 of the jack plug so that the jack would have a tip portion and a sleeve portion. As shown in FIGS. 2 and 3, without insertion of a jack plug (FIG. 2), portion 36 of electrical contactor 14 abuts electrode 60 to make electrical connection therewith and a portion 37 of contactor 16 abuts electrode 40 to make electrical contact therewith. Vertical insertion of the elongated jack plug stem 20 within collar member 22 (FIGS. 3 and 5) results in yieldable tongue-like end portion 32a of contactor electrode 16 which is substantially V-shaped, riding over the first enlarged stem portion to engage tip portion 24 to establish electrical conduction with external circuits including such components as 55 and 57, shown in FIG. 1, mounted on horizontally disposed printed circuit board 56 while breaking electrical contact with electrode 40 as shown in FIG. 3. Further, portion 36a of contactor electrode 14 electrically contacts the ring portion 25 of the jack plug as shown in FIG. 3 and causes electrical disengagement between electrical contactor 14 and electrode 60. In some applications it may be desired to eliminate electrode 40. In such application, to provide a mechanical stop for contactor 16 a post 39, integrally formed with housing 12, is provided.

Referring to FIGS. 1–7, the rigid rectangular, parallelepiped box-like housing 12 comprises an integrally formed unitary structure of electrically insulating material with a vertical planar front wall 76 incorporating the appended externally threaded collar member 22. A horizontal passageway 21 in collar member 22 is sized to guide and slidably receive the stem portion 20 of jack plug inserted axially within the housing parallel with respect to the mounting board 56 when the jack is mounted horizontally (FIG. 1). A sleeve spring electrode 126 (FIGS. 1 ∝ 6 and 9) is provided external of the housing 12 having an aperture formed therein to enable such electrode 126 to slip over the collar member 122. An intermediate spring finger 152 protrudes over the front wall 76 of the housing to contact the sleeve portion 26 of the jack plug. The threaded collar member 22 may be extended through an appropriate aperture in a vertically conductive panel board 121 (FIGS. 2 and 3) and the jack may be secured by washers 122, 123 and nut 124 to such panel. Further, for insulating, for example, the sleeve electrode 126 from the mounting panel, washer 122 is selected to be a nonconductive, insulating material. When electrical contact is desired between the sleeve electrode 126 and the panel 121, washer 122 is omitted. Front wall 76 also defines along its uppermost edge molded beveled raised wall portions 81, 82 (FIG. 6) and an intervening space 84. Studs 83, 85 are molded in the top edge of the wall portions 81, 82, respectively, to accommodate holes 150, 151 in spring fingers 148, 149 of the unitary, separable, sleeve electrode member 126 for latching and retaining housing cover 128 to enclose the housing 12, as shown in FIG. 1.

Figures 6, 7, 9:
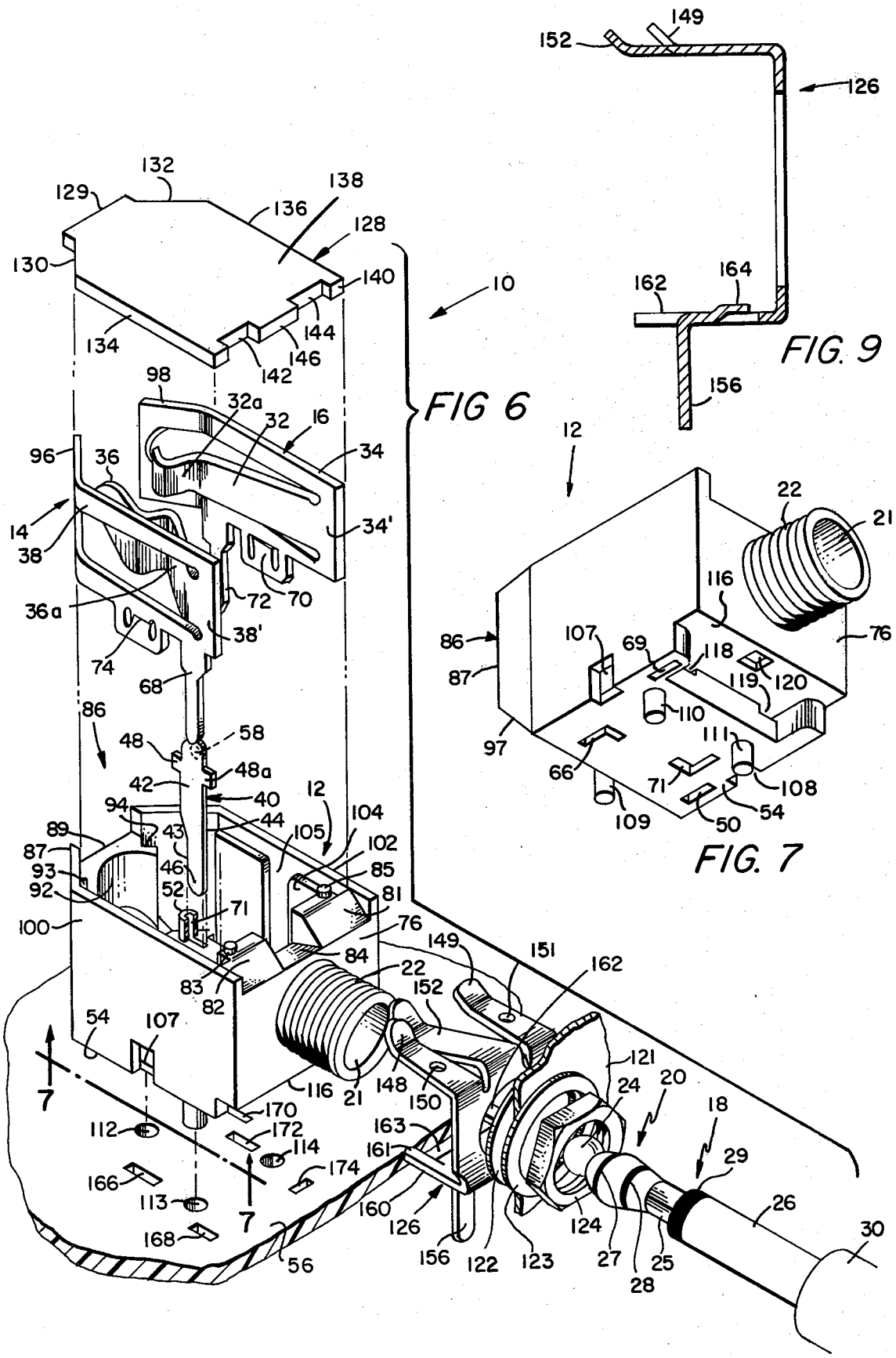
FIG. 6 is an exploded pictorial view of the embodiment shown in FIGS. 1–5, inclusive, together with a fragmentary portion of a printed circuit mounting board.
FIG. 7 is a perspective side and bottom elevation view of the jack housing shown in FIGS. 1–5 taken along the line and viewed in the direction of arrows 7—7 in FIG. 6; and is shown less the electrodes.
FIG. 9 is a cross section elevation view of a contactor electrode used in the jack shown in FIG. 1.

Horizontally disposed bottom wall 54 has generally semicircular reinforcing sections 77, 78 inwardly disposed, for guiding portions of jack plug stem 20 into housing cavity 80. Further, such wall 54 is provided with molded reinforcing posts 109, 110, 111 (FIG. 7) to assist in alignment of the jack housing on mounting board 56 for horizontal mounting by positioning such posts within companion openings 112, 113, 114 (FIG. 6) formed in the printed circuit board. Such posts protect the relatively thin perpendicularly disposed finger-like external circuit connectors of the spring contactor and shunt electrodes inserted through appropriate slots molded in bottom wall 54 into mating slots in circuit mounting board 56, as shown in FIGS. 6 and 7, from being deformed by mechanical forces from insertion and retraction of the jack plug in and out of the cavity. Slots 50, 66, 69, 71 are molded in bottom wall 54 (FIG. 7) to receive the electrode terminal connectors and connection to external circuits through matching slots in circuit board 56, as shown in FIG. 6. Further, the bottom wall portion of the molded jack housing 12 formed adjacent to front wall 76 comprises a right angular notched portion 116 having slots 118, 119 and pocket 120 (FIG. 7) for receiving and anchoring portions 161, 162, 164 of the unitary sleeve electrode member 126 (FIG. 9).

Rear wall 86 (FIGS. 2, 3, 6 and 7) defines central portion 89 and angled corner portions 87, 88 to effectively reduce overall size and weight of the unitary jack housing structure. Wall portion 89 is enlarged as at 91 with a curved section 92 and grooves 93, 94 to receive and lock the rear sections 96, 98 of contactor electrodes 14, 16, respectively. Additionally, the upper wall edge of wall portion 89 is notched as at 90 (FIGS. 1, 4,5) to accommodate and anchor tab 129 of cover member 128 (FIG. 6) in the final assembly of the overall jack housing 12 unitary structure to fully enclose the contactor and shunt electrodes assemblies. A section of rear wall 86 adjoining bottom wall 54 is tapered as at 97 (FIGS. 4, 5) to further reduce weight, size and cost of the overall electrical jack 10 structure.

Referring to FIGS. 2, 3 and 6, opposing parallel planar sidewalls 100, 102 are provided in the integral molded housing structure and include frame members 104 along with vertical grooves 105 adapted to receive mounting lug portions 70, 74 of contactor electrodes 16, 14, respectively, as shown in FIG. 6. The intersecting corners of the abutting sidewalls 100, 102 and front wall 76 are also provided with grooves (not shown) similar to grooves 93, 94 (FIGS. 1, 2, 3 and 6) to anchor the planar ends 38', 34' of contactor electrodes 14, 16 (see in FIGS. 2 and 3). Parallel sidewalls 100, 102 are also provided with pockets 107, 108 (FIGS. 1, 7) adjacent to the terminal ends of the vertical grooves 105, within which the aforementioned lugs 70, 74 are anchored when the contactor electrodes 14, 16 are secured in the mounted position within housing 12 slightly received below the uppermost edge of walls 100, 102, as shown in FIG. 1.

To complete the jack housing structure and provide a completely dust resistant and tamper resistant enclosure, cover 128 of insulating material and substantially rectangular configuration is provided and will now be described, reference being directed to FIG. 6. The cover 128 is recessed and fits flush within the uppermost edges of the walls defining the front, rear and sidewalls of the housing 12 and is supported by the upper edge of front wall raised portions 81, 82, rear walls portion 91 and sidewall frame portions 104. Cover 128 comprises a rear edge wall tongue portion 129 dimensioned to interfit within notch 90 in housing rear wall 89. Adjacent to the tongue portion 129 are angled edges 130, 132 adapted to mate with corner walls 87, 88 of the housing 12. Parallel opposing edges 134, 136 defining therebetween the major wall portion 138 follow and mate with opposing sidewalls 100, 102 of the jack housing 12. Front edge 140 is provided with two notch portions 142, 144 to rest against raised wall portions 81, 82, respectively of front wall 76 with an intermediate tongue-like portion 146 in the intervening space 84.

Referring to FIGS. 2–6 the yieldable spring contactor electrodes of the invention will be described. Electrodes 14, 16 are disposed opposite to one another within the housing cavity 80 and are spaced to receive the inserted jack plug stem 20. Tongue-like portion 36 of electrode 14, having an intermediate substantially V-shaped portion 36*a* engages ring portion 25 of stem 20 after the jack plug 18 is inserted, see FIG. 3, to establish external circuit connections. Contactor electrode 14 is fabricated preferably, by stamping from a resilient conductive sheet metal strip 38 and includes mounting lug 74 and finger-like external circuit connector 68 disposed perpendicular to the tongue portion 36 together with a planar angular rear section 96 conforming portion to housing wall 87 (FIG. 6). By changing the fabrication dies for the external circuit connector 68, the spring contactor electrodes can be quickly converted to conventional solder type mounting with quick connect connectors and the remainder of the components of the electrodes and housing remain the same. External circuit connector 68 extends through slot 69 (FIG. 7) in bottom wall 54 and matching slot 168 in board 56 (FIG. 6) to engage conventional printed circuit transmission lines underlying the board 56, not shown for the sake of clarity in understanding the invention. Electrode 14 will also be referred to herein as the ring spring electrode.

Referring to FIGS. 2, 3 and 6 spring contactor electrode 16 is illustrated. This electrode is also fabricated as a unitary structure, as by stamping from a resilient conductive sheet metal strip 34 and includes a mounting lug 70, finger-like external circuit connector 72 disposed perpendicular to the tongue portion 32, V-shaped end portion 32*a* and flat angular housing wall conforming portion 98. External circuit connector 72 extends vertically through slot 50 in bottom wall 54 of housing 12 (FIG. 7) and through slot 170 in mounting board 56 (FIG. 6) to be electrically connected to underlying printed circuit lines. Upon insertion of jack plug stem 20 into cavity 80 the tip portion 24 establishes electrical contact with electrode portion 32*a*. The electrode 16, therefore, may also be referred to herein as the tip spring electrode.

In accordance with the invention and referring now to FIGS. 1–6, particularly FIG. 6 shunt electrode 40 will be described. Such electrode comprises a substantially flat section 42 of resilient conductive sheet metal strip 42 having opposed parallel side edges 43, 44 defining finger-like external circuit connector 46. Laterally outstanding ears 48, 48*a* provide for limitation of insertion of the shunt electrode 40 within a slot 71 in internal molded boss 52 in the bottom wall 54 of the housing 12. External circuit connector 46 projects outwardly substantially perpendicular to the jack housing longitudinal axis and provides for connection to external circuitry by means of conventional printed circuit boards. With appropriate modification quick connect soldering connectors may also be provided by changing the fabrication dies for stamping the shunt electrode 40. The opposing end of the shunt electrode 40 supports raised dimple section 58 for use in electrically engaging an associated mating spring contactor electrode 16 tongue-shaped portion 32 (FIG. 2) to provide a normally closed circuit configuration prior to jack plug stem insertion (FIG. 3). This results in the movement of electrode portion 32 away from the shunt electrode and opening of the normally closed circuit. Retraction of the jack plug stem 20 restores the normally closed circuit.

In a similar manner and referring again to FIG. 2, shunt electrode 60 having a dimple section 62 and perpendicularly extending external circuit connector 64 (FIG. 1) contacts ring spring electrode 14 tongue-like portion 36 at its inner end. The connector 64 extends through slot 66 (FIG. 7) in housing bottom wall 54 and slot 166 in board 56 (FIG. 6) for connection to external circuitry. Again, the engagement of inserted jack plug stem 20 insulated ring portion 25 by portion 36*a* of electrode 14 moves tongue 36 away from shunt electrode dimple 62 to open the normally closed circuit (FIG. 3) and switch the circuit connected to electrode 14 to another external circuit connected to ring portion 25. Removal of jack plug stem 20 will restore the circuits to the normally closed position.

Figure 5:
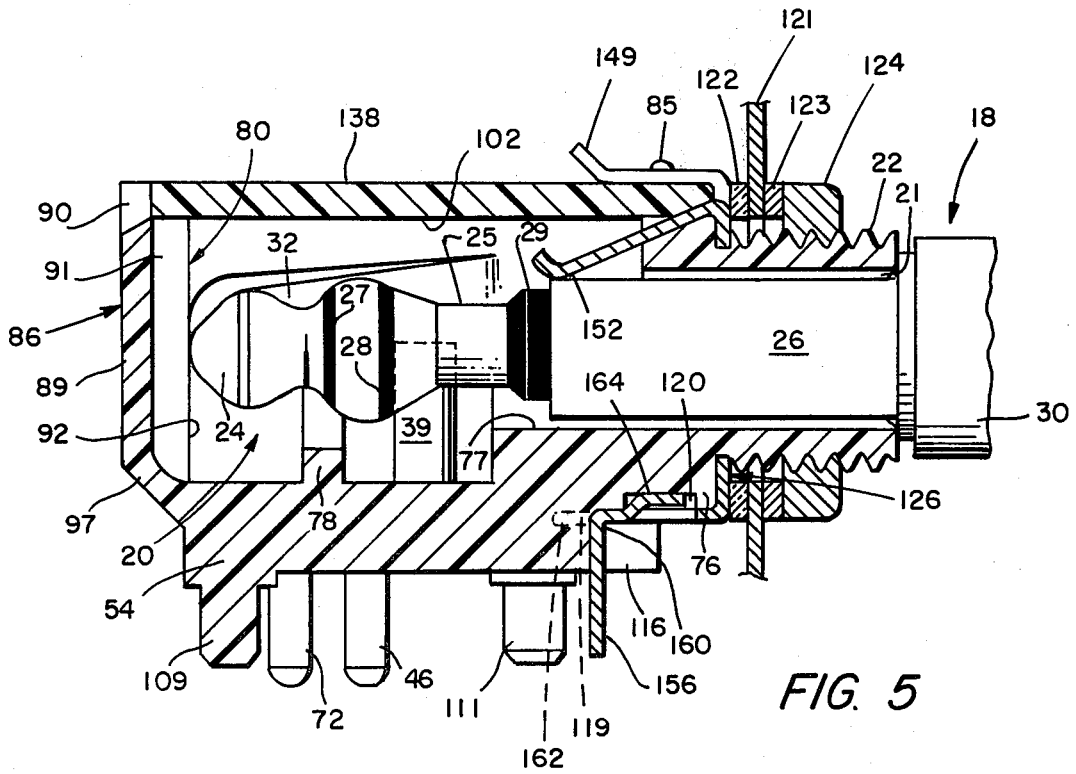
FIG. 5 is a side elevation view of the embodiment, partly in cross section with the jack plug stem inserted, taken along the line and viewed in the direction of arrows 5—5 in FIG. 3.

Referring particularly to FIGS. 1, 4, 5, 6 and 9 another feature of the invention will now be described, namely the unitary, integral, separable sleeve electrode member 126 externally mounted on housing 12. Fabrication from resilient conductive sheet metal strip provides all the components of such unitary sleeve electrode 126 including laterally extending spring fingers 148, 149 having holes 150, 151 adapted to receive studs 83, 85 of wall portions 81, 82. Fingers 148, 149 are disposed at right angles to flat wall portion 154 and retain cover 128 in the closed recessed position by exerting a downward pressure on the major portion 138 of such cover (FIG. 1). Intermediate spring finger 152 having a slightly increased downward angular orientation (FIGS. 4, 5) is provided to be introduced into housing cavity 80 and engage the sleeve portion 26 of jack plug stem 20 when inserted within the housing cavity 80, as shown in FIG. 5. Spring 152 provides an electrically conductive path to perpendicularly disposed finger-like external circuit connector 156. Spring member 152 extends within the space 84 defined in the upper portion of housing wall 76 (FIG. 6) and is substantially enclosed by the cover member 128 intermediate portion 146 when the cover is positioned to enclose the overall jack housing structure (FIG. 1). Flat portion 154 of the sleeve contactor electrode 126 is also provided with a circular aperture 158 dimensioned to receive collar member 22. Following the flat portion 154 is a right angular portion 160 including key members 161, 162 separated by a notch 163. The key members 161, 162 are adapted to be fitted within slots 118, 119 (FIG. 7) to anchor the sleeve electrode 126 in its external mounted position with collar member 22 extending through the aperture 158 and posts 83, 85 latched to fingers 148, 149 (FIGS. 1 and 5). In addition, the positioning of the sleeve electrode member on the jack housing 12 is positively locked by means of pocket 120 in wall portion 116 receiving mounting lug 164 when the key members 161, 162 extend within slots 118, 119 (FIGS. 4, 5). Unitary, integral sleeve electrode member 126, therefore provides a multi-purpose structure for the retention of cover 128 to completely enclose the jack housing, a yieldable spring contactor sleeve electrode and an external circuit connector. By omitting washer 122, the electrode 126 is electrically connected to panel 121. The electrode 126 can be electrically insulated from panel 121 if the washer 122 is of insulating material.

Referring to FIGS. 1 and 6 the ease of assembly of the preferred embodiment of the invention on a circuit mounting board 56 with the perpendicularly disposed finger-like external circuit connectors 46, 64, 68, 72 and 156 and reinforcement posts 109, 110, 111 (FIG. 1) will now be described. The outwardly disposed external circuit connectors extend perpendicularly below bottom wall 54 of the jack housing 12 and are aligned with appropriate slots in circuit board 56 (FIG. 6). Circular holes 112, 113, 144 provide for disposition of posts 109, 110, 111 in bottom wall 54, as hereinbefore described Tip shunt electrode 40 external connector 46 extends vertically within mounting board slot 172 and tip spring contactor electrode 16 external connector 72 extends within slot 170. On the opposing side ring shunt electrode 60 external connector 64 extends through slot 166 in board 56 while the ring spring contactor electrode 14 external connector 68 is vertically disposed in slot 168 for connection to circuits by conventional techniques. Finally, sleeve member external circuit connector 156 extends vertically through slot 174. Selection of circuit switching configurations and the axial insertion and removal of jack plug stem 18 with associated tip, ring and sleeve portions within the housing cavity 80 through collar member 22 passageway 21 provides for engaging yieldable contactor electrode members 14, 16 and 152 to thereby open normally closed circuits and hold these open until removal of jack plug stem or establish circuits and hold continuity until removal of the jack plug.

Figure 8A:
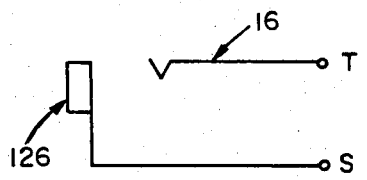
FIGS. 8A–8F, inclusive, are schematic circuit illustrations of the numerous arrangements available with the illustrative embodiment of the invention.
Figure 8B:
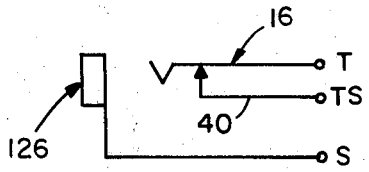

The number of circuit arrangements possible in the practice of the invention are illustrated in FIGS. 8A–8F, inclusive. FIG. 8A illustrates a two conductor arrangement including only tip spring and sleeve electrodes 16, 126 for connection by terminals T and S to external circuits. FIG. 8B introduces tip shunt electrode 40 which contacts electrode 16 in the position shown in FIG. 2 to provide a normally closed circuit. Terminals T, TS and S provide a three terminal network for connection to external circuitry.

Figure 8C:
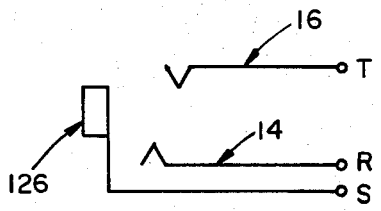
Figure 8D:
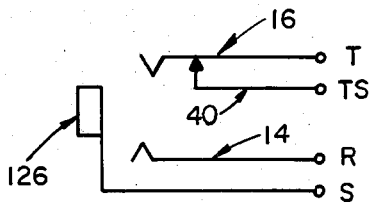

FIG. 8C comprises a three conductor arrangement including tip spring electrode 16, ring spring electrode 14 and sleeve electrode 126 together with appropriate terminals T, R and S. In FIG. 8D shunt electrode 40 is reintroduced to provide normally closed circuit involving the tip spring electrode 16 before the insertion of the jack plug stem. Four terminals are available, namely T, TS, R and S.

Figure 8E:
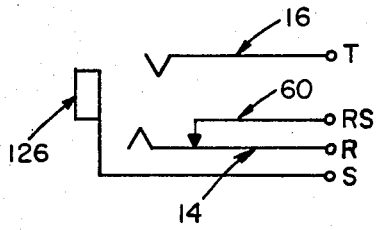
Figure 8F:
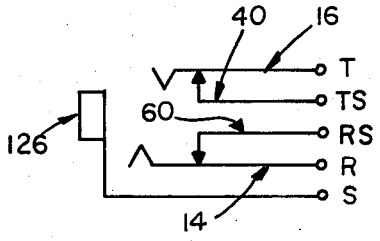

In FIG. 8E additional ring shunt electrode 60 is introduced into the circuit to closed circuit with ring spring electrode 14. Shunt electrode 60, as shown in FIG. 2 in the closed position and FIG. 3 in the open position contacts ring spring electrode 14. Four terminals, specifically, T, RS, R and S are available for an external circuit network. The final circuit arrangement of the series, as shown in FIG. 8F again incorporates tip shunt electrode 40 to provide a five terminal network with two normally closed circuits which are opened by the insertion of the jack plug stem and switched to other circuits coupled to the stem portion and a normally open sleeve electrode circuit. The terminals are T, TS, RS, R and S.

This completes the description of a preferred embodiment of the invention for use with associated audio/phone circuits. Numerous other arrangements, required or preferred, will become obvious to those skilled in the art and are considered to be within the scope and breadth of the invention as defined in the appended claims. All matter shown and described herein relating to the preferred embodiment is, therefore, to be interpreted as illustrative only and not in a limiting sense.

What is claimed is:

1. An electrical jack, comprising:

(a) a housing of insulating material having integral walls, including a front wall, forming a cavity, said front wall having an axially extending dielectric collar member with a passageway for guiding a stem of a jack plug into said cavity;

(b) at least one spring contact electrode disposed within said housing cavity adapted to engage a portion of the jack plug stem when such stem is inserted into the cavity to establish electrical contact between such electrode and such portion of the jack plug; and (c) an electrical contactor electrode having an aperture formed in a mounting portion thereof disposed around the dielectric collar member outside the housing and having a finger electrode protruding across the front wall of the housing into the cavity to electrically contact a different portion of the jack plug.

2. The electrical jack recited in claim 1 including additionally a cover for such cavity and wherein the electrical contactor electrode includes at least one spring finger protruding over the front wall to secure the cover to the housing.

3. The electrical jack recited in claim 2 wherein the electrical contactor electrode has an external connector portion integrally formed therewith.

4. An electrical connector comprising:

a housing having wall means for forming an inner cavity, the wall means including a dielectric front wall having an axially outwardly extended integral collar means for defining a dielectric passageway in communication with said cavity and permitting insertion of a mating connector into said cavity;

first electrical contact means disposed within said cavity for engagement with a first portion of said mating connector; and second electrical contact means disposed exteriorly on said front wall and having a mounting portion disposed around said collar means, said second electrical contact means including another portion extended over an edge portion of said front wall into said cavity for engagement with a second portion of said mating connector.

5. An electrical connector as set forth in claim 4 wherein said wall means includes a second wall comprising a removeable cover disposed adjacent said first wall; and said second electrical contact means includes a resilient finger means extended over onto said cover for holding said cover in place on the housing.

6. An electrical connector as set forth in claim 5 wherein said wall means includes a third wall disposed adjacent said first wall and provided with a slot; and said second electrical contact means includes tab means extended over onto said third wall for retaining engagement in said slot.

* * * * *